US011878200B2

(12) United States Patent
Duplain

(10) Patent No.: US 11,878,200 B2
(45) Date of Patent: Jan. 23, 2024

(54) ADAPTIVE WEIGHT BELT FOR RETROFITTING A BARRED WEIGHT

(71) Applicant: DB MODS INC, Lake Worth, FL (US)

(72) Inventor: David Duplain, Lake Worth, FL (US)

(73) Assignee: DB Mods Inc., Lake Worth, FL (US)

( * ) Notice: Subject to any disclaimer, the term of this patent is extended or adjusted under 35 U.S.C. 154(b) by 94 days.

(21) Appl. No.: 17/718,178

(22) Filed: Apr. 11, 2022

(65) Prior Publication Data

US 2023/0321475 A1 Oct. 12, 2023

(51) Int. Cl.
*A63B 21/075* (2006.01)
*A63B 21/072* (2006.01)

(52) U.S. Cl.
CPC ..... *A63B 21/075* (2013.01); *A63B 21/0724* (2013.01)

(58) Field of Classification Search
CPC . A63B 21/06; A63B 21/0601; A63B 21/0609; A63B 21/065; A63B 21/072; A63B 21/0726; A63B 21/0728; A63B 21/075
See application file for complete search history.

(56) References Cited

U.S. PATENT DOCUMENTS 4,396,190 A 8/1983 Wilkerson
5,709,634 A 1/1998 Pointer
6,328,678 B1 12/2001 Romero
7,128,667 B2 * 10/2006 Nolan ..... A63B 21/06 473/422
7,771,330 B2 8/2010 Towley, III
8,007,416 B2 4/2011 Arlie
8,900,104 B2 * 12/2014 Shozda ..... A63B 21/0728 482/106
9,302,141 B2 4/2016 Haley
2006/0009336 A1 1/2006 Millet
2006/0293155 A1 12/2006 Hamilton
2009/0205106 A1 * 8/2009 Sohn ..... A63B 71/14 607/114
2013/0316880 A1 * 11/2013 Bosse ..... A63B 21/0728 482/107
2014/0155234 A1 6/2014 Justice
2015/0031508 A1 1/2015 Goldberg
2017/0361148 A1 * 12/2017 Black ..... A63B 21/0604

* cited by examiner

*Primary Examiner* — Joshua Lee
(74) *Attorney, Agent, or Firm* — CRGO Global; Steven M. Greenberg

(57) ABSTRACT

An adaptive weight belt retrofitting which incrementally increases a weight characteristic of a bar weight includes a fabric strap and multiple different metallic plates, each which slidably envelop a portion of the fabric strap so as to permit each of the plates to slide along the fabric strap so as to permit a reconfigurable distance on the fabric strap between each of the plates. Notably, at least one of the plates includes a patch of friction bearing material such that an interior portion of the fabric strap has a fastener adapted for coupling to the friction bearing material. In this way, the adaptive weight belt wraps a circumferential surface of one of two different weighted circumferential structures positioned oppositely along a bar of the bar weight, thereby incrementally increasing the weight characteristic of the bar weight.

16 Claims, 4 Drawing Sheets

ADAPTIVE WEIGHT BELT FOR RETROFITTING A BARRED WEIGHT

BACKGROUND OF THE INVENTION

Field of the Invention

The present invention relates to the field of training equipment and more particularly to a barred weight accessory.

Description of the Related Art

Physical fitness includes the combined concepts of cardiovascular exercise and strength training. As to the latter, strength training primarily requires the use of specialized equipment by the individual so as to target the strengthening of specific groups of muscles. The most common tool, of course, is the barred weight in which weights are positioned at opposite ends of a bar. And, the most common construct of the barred weight is the combination of bar and weighted circumferential structures, such as circular discs or hexagonal discs. There are essentially two types of traditional bar weights combining a bar with weighted circumferential structures.

In the first instance, each weighted circumferential structure of correspondingly equal weight is permanently affixed to opposing ends of the bar so that the total weight represented by the bar weight is fixed and cannot be changed. The foregoing is most commonly found in the form of a dumbbell in which the bar is of limited length and designed to be held by a single hand. In the second instance, each weighted circumferential structure is only temporarily affixed to the opposing ends of the bar so that the total weight of the bar weight can be adjusted by either replacing the weighted circumferential structures affixed to the bar with differently weighted circumferential structures, or by adding or removing weighted circumferential structures from the bar.

In the former instance, where each bar weight is of fixed weight, in order to provide a variety of differently weighted bar weights, the user must store a multiplicity of different bar weights—typically on a rack of dumbbells, quite large in footprint. In the latter instance, where each bar weight can vary in weight according to the addition or removal of differently weighted circumferential structures, in order to provide a variety of different weighted bar weights, the user must store a multiplicity of different weighted circumferential structures, typically on a spike of stacked weighted circumferential structures. In either circumstance, as can be seen, a storage facility must be provided, for example a rack of the dumbbells, or a stack of the weighted circumferential structures. Yet, in a space limited setting, either circumstance is not preferred. This problem can be compounded in the home setting where the weight set of the end user must be augmented, but to do so requires the purchase of additional weights and thus additional storage structures. Even further, increased weights can be very costly and when many different increments of increased weights beyond that of an existing set of weights is required, the costs can act to prevent the home user from accessing a bar weight of desired weight.

BRIEF SUMMARY OF THE INVENTION

Embodiments of the present invention address deficiencies of the art in respect to the variable weighting of a bar weight and provide a novel and non-obvious adaptive weight belt retrofitting a bar weight. In an embodiment of the invention, an adaptive weight belt which incrementally increases a weight characteristic of a bar weight includes a fabric strap and multiple different metallic plates, each which slidably envelop a portion of the fabric strap so as to permit each of the plates to slide along the fabric strap so as to permit a reconfigurable distance on the fabric strap between each of the plates. Notably, at least one of the plates includes a patch of friction bearing material such that an interior portion of the fabric strap has a fastener adapted for coupling to the friction bearing material. In this way, the adaptive weight belt wraps a circumferential surface of one of two different weighted circumferential structures positioned oppositely along a bar of the bar weight, thereby incrementally increasing the weight characteristic of the bar weight. Indeed, owing to the belted nature of the adaptive weight belt, the adaptive weight belt, when of a length that is an integer multiple of the circumference of an existing plate, can be applied to a bar weight with multiple circumferential wrappings of the plate to produce an even greater weight increase of the plate beyond that of a single wrapping of the plate.

In one aspect of the embodiment, the fastener is a loop surface and the friction bearing material is a hook surface engaging the loop surface. Alternatively, in another aspect of the embodiment, the fastener is a hook surface and the friction bearing material is a loop surface engaging the hook surface. Oppositely, each plate can slidably envelop the strap in a channel defined by a top surface of the plate and a cross member fixed to the top surface. In this regard, the cross member can be an integral portion of the plate extending from one portion of the top surface and terminating at another portion of the top surface and defining a slot therethrough. Or, the cross member can be a separate structure secured to the top surface of the plate.

In either circumstance, the weight belt can include a thumbscrew that has been positioned through a top surface of the plate to a bottom surface of the plate and embedded into the strap to prevent lateral movement of the plate along the strap. Optionally, each plate includes a pair of subplates fixed to one another about the strap such that the sub-plates frictionally engage each surface of the strap with a corresponding interior surface of each of the sub-plates.

In another embodiment of the invention, an adaptive weight belt for incrementally increasing a weight characteristic of a bar weight includes a fabric strap and multiple different metallic plates. Each of the plates slidably envelops a portion of the fabric strap so as to permit each plate to slide along the fabric strap and so as to permit a reconfigurable distance on the fabric strap between each of the plates. At least one of the plates includes a patch of friction bearing material and at least one other of the plates additionally includes a ring. As such, a surface of the fabric strap at a distal end of the strap has a fastener adapted for coupling to the friction bearing material after having been passed through the ring. In this way, the adaptive weight belt wraps a circumferential surface of one of two different weighted circumferential structures positioned oppositely along a bar of the bar weight, thereby incrementally increasing the weight characteristic of the bar weight.

In one aspect of the embodiment, the surface is a top surface such that the fastener couples to the friction bearing material after having reversed direction around the circumferential surface of the dumbbell when passed through the ring. In this regard, in some commercial settings, a dumbbell as the weight increases maintains a same diameter of the circumferential weights at the distal ends of the dumbbell and instead, merely become wider to account for the greater weight. Thus, the use of a ring to permit a reversal of direction of the belt allows the belt to achieve maximum tension upon the surface of the dumbbell despite the change in width of the circumferential weights of the dumbbell.

In yet a further embodiment of the invention, an adaptive weight belt for incrementally increasing a weight characteristic of a bar weight includes a fabric strap and multiple different metallic plate assemblies. Each of the assemblies slidably envelopes a portion of the fabric strap, the slidable envelopment permitting each of the plate assemblies to slide along the fabric strap so as to permit a reconfigurable distance on the fabric strap between each of the plate assemblies. As well, each of the plate assemblies includes two or more plate segments positioned immediately adjacent to one another at respective edges and at an obtuse angle to one another when secured to an outer surface of a weighted circumferential structure of the bar weight. As before, at least one of the plate assemblies comprising a patch of friction bearing material and an interior portion of the fabric strap has a fastener adapted for coupling to the friction bearing material.

In one aspect of the foregoing embodiment, the plate segments are removably secured to another but permitted to position against one another at the obtuse angle by a flexing of the strap. The plates in the assembly are connected together at the bottom by a continuous patch of rubber or hook friction pad material. The fabric strap, for instance, can be a hook and loop strap. In another aspect of the foregoing embodiment, the plate segments are formed from a unitary body of material. In yet another aspect of the embodiment, each plate assembly includes two plate segments. However, in an alternative aspect of the embodiment, each plate assembly includes three plate segments positioned in sequence to one another as two adjacent pairs of the segment, and a first angle formed by a first one of the adjacent pairs is equivalent to a second angle formed by a second one of the adjacent pairs.

In consequence of the foregoing, it will be apparent to one of skill in the art that an existing set of barred weights can be expanded in weight, incrementally, without requiring the costly purchase of additional plates or dumbbells. Further, in consequence of the foregoing, it will be apparent to one of skill in the art that an existing set of barred weights can be expanded in weight, incrementally, without requiring the space inefficient arrangement of additional storage racks to support newly purchased plates or dumbbells. Indeed, whereas oftentimes home users purchase a set of dumbbells across a range of weights with a corresponding rack, incrementally increasing the heaviest of those dumbbells requires a completely new storage mechanism since the rack provided with the original set of dumbbells will have been filled with the initial set of weights. The adaptive weight belt described herein avoids both the excess cost of a completely new set of dumbbells, and also the necessity for additional racks to store additional dumbbells.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Embodiments of the invention provide for an adaptive weight belt configured for incremental increasing the weight characteristic of a bar weight. In accordance with an embodiment of the invention, an adaptive weight belt includes a fabric strap to which multiple different plates are slidably affixed. That is, each of the plates includes structure which frictionally envelopes the strap while permitting each of the plates to change position along the fabric strap. One or more of the plates has a patch of friction bearing material disposed on a top surface of the plate which couples to a fastener disposed at an interior portion of the fabric strap. In this regard, the friction bearing material by way of example can be loop material whereas the fastener is a multiplicity of hooks.

Operationally, then, the fabric strap with the multiple different plates wraps the weighted circumferential structure of a bar weight. As well, the interior portion of the strap secures the strap to an exterior portion of the plates by way of the coupling of the fastener to friction bearing material. As a result, the adaptive weight belt provides an incremental increase in the total weight of the bar weight. Further, the slidability of the plates on the fabric strap of the adaptive weight belt permits an adaptation of the weight belt to any circumference or shape of the bar weight. Additionally, one or more of the plates can include a patch of friction bearing loop material disposed on a top surface of the plate which can couple to a patch of hook material disposed on the interior face of one or more plates attached to another belt. By providing this connection, additional belts can be added on in layers in the same manner described above to incrementally increase the total weight exponentially.

Figure 1:
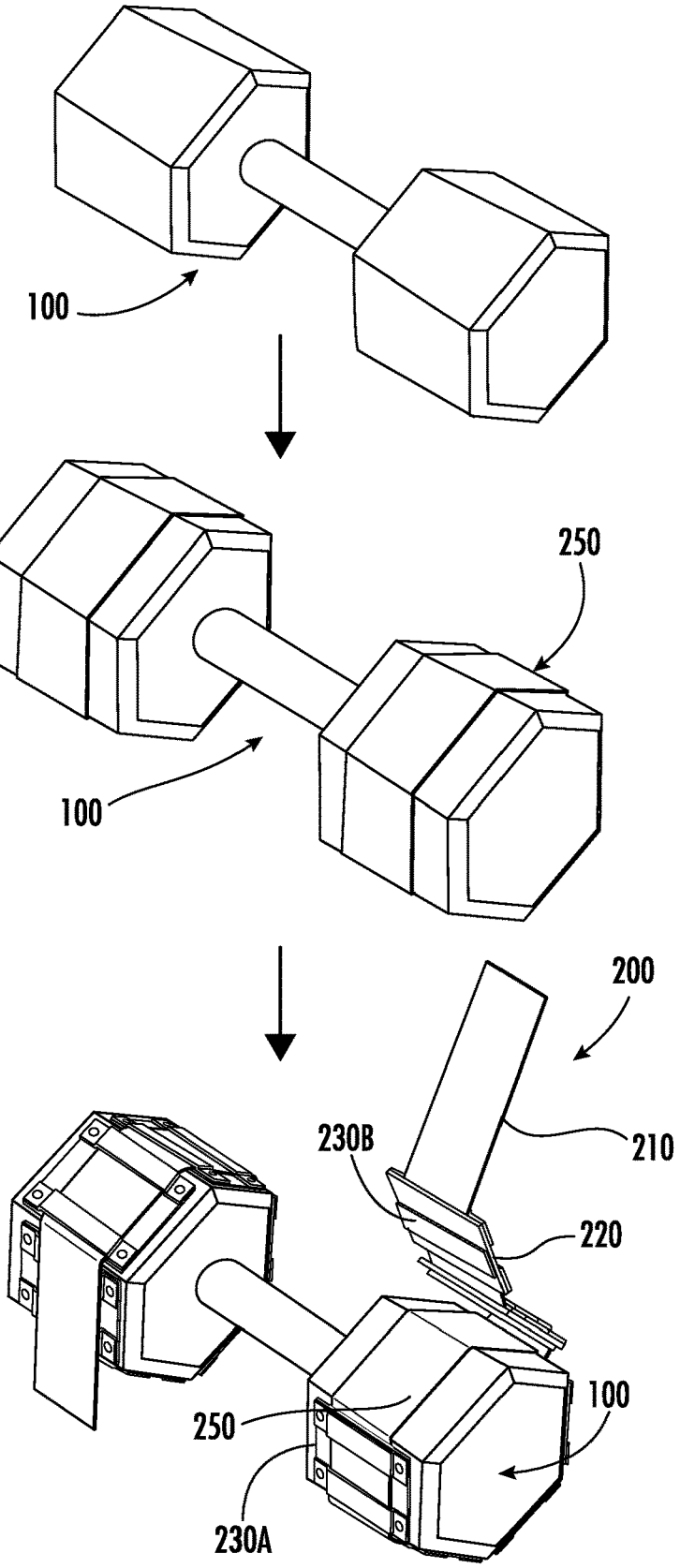
FIG. 1 is pictorial illustration of the incremental increasing of a weight characteristic of a bar weight with an adaptive weight belt.

In further illustration, FIG. 1 pictorially shows an incremental increasing of a weight characteristic of a bar weight with an adaptive weight belt. As shown in FIG. 1, an adaptive weight belt 200 wraps each end of a barred weight 100. The adaptive weight belt 200 includes different plates 220, each slidably affixed to a fabric strap 210 so that each of the plates 220 can slide along the fabric strap 210 to a specific position, generally, one of the plates 220 for each side surface of the end of the barred weight 100. A top portion of the plates 220 each has a patch 230A of friction bearing material disposed thereon, which couples to a fastener disposed at an interior portion of the fabric strap 210. In this regard, the friction bearing material by way of example can be loop material whereas the fastener is a multiplicity of hooks.

To ensure that the adaptive weight belt 200 remains secured to a corresponding end of the barred weight 100, additional friction bearing material 230B is disposed on an interior portion of each of the plates 200, for example a rubber pad. The contact between the additional friction bearing material 230B and a surface of the end of the barred weight 100 inhibits slippage of the adaptive weight belt 200 from the end of the barred weight 100. Optionally, a band 250 of friction bearing material also is applied to each end of the barred weight 100 prior to wrapping each end with the adaptive weight belt 200 so that the contact between the band 250 of friction bearing material and the additional friction bearing material 230B of the adaptive weight belt 200 inhibits slippage of the adaptive weight belt 200 from the end of the barred weight 100.

Figure 2A:
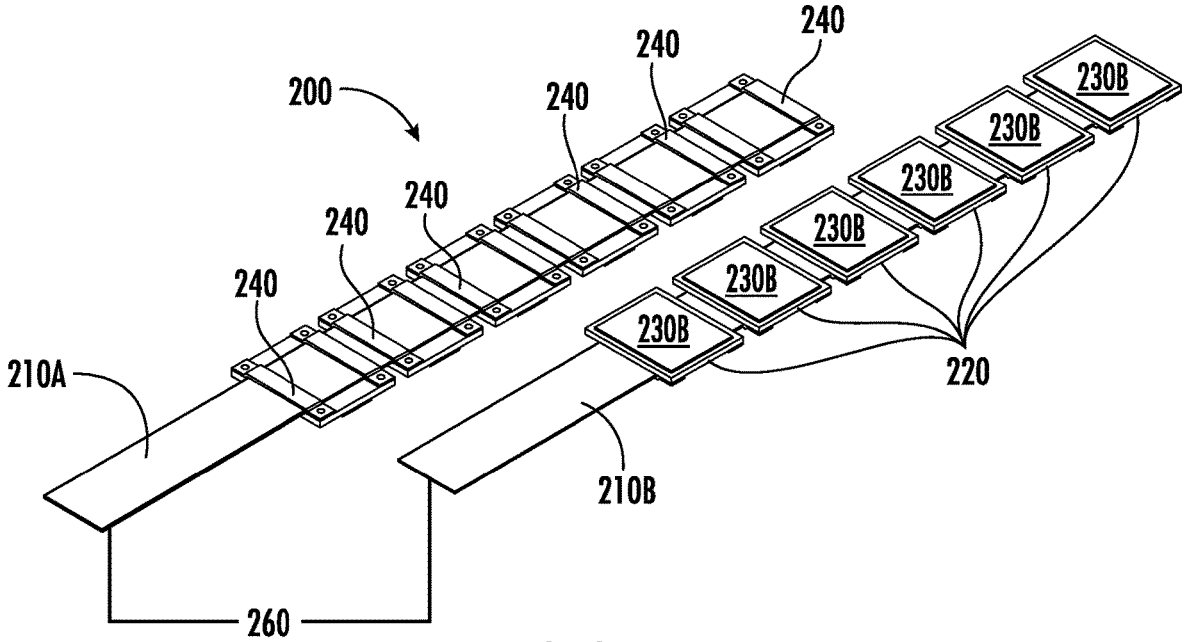
FIGS. 2A and 2B, taken together, are a perspective view of an adaptive weight belt for incrementally increasing a weight characteristic of a bar weight.
Figure 2B:
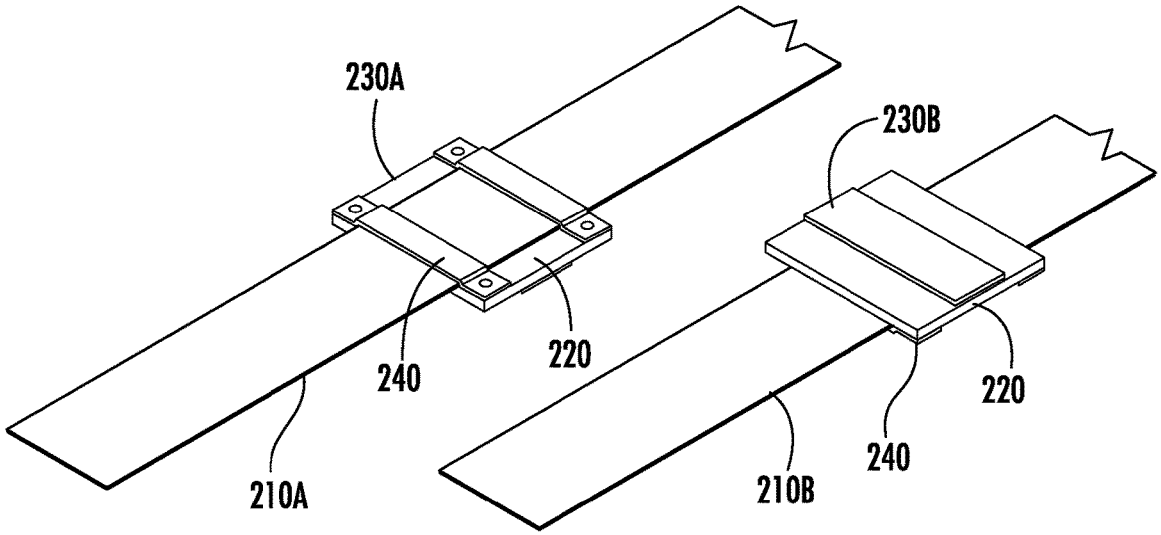

In further illustration of the structure of the adaptive weight belt 200 of FIG. 1, FIGS. 2A and 2B, taken together, are a perspective view of an adaptive weight belt for incrementally increasing a weight characteristic of a bar weight. In one embodiment of the adaptive weight belt 200, a multiplicity of different plates 220 are each slidably affixed to a fabric strap 260 with a top surface 210A having loop material and a bottom surface 210B having hook material adapted for securing to the loop material. Each of the plates 220 may be slidably affixed to the fabric strap 260 by friction fitting the fabric strap 260 between a top surface of a corresponding one of the plates 220, and to one or more cross members 240 each secured to the top surface of the corresponding one of the plates 220. The slidable fit allows for the corresponding one of the plates 220 to slide along the fabric strap 260 with force applied, but the friction fit of the strap 260 inhibits ad hoc sliding without an application of lateral force to the corresponding one of the plates 220

Notably, portions of the loop material of the top surface 210A remain accessible in the present embodiment in between the cross members 240. In an alternative embodiment, however, in lieu of cross members 240, an additional plate may sandwich the fabric strap 260 and additional loop material may be affixed to the outer surface of the additional plate as a patch. As yet another alternative, additional loop material may be affixed to a top surface of the one or more cross members 240. As it will be understood, as the adaptive weight belt 200 wraps an end of a barred weight like a dumbbell, the hook material of the bottom surface 210B of the fabric strap 260 engages the loop material of the top surface 210A so as to secure the adaptive weight belt 200 to the end of the dumbbell. Further, as can be seen, a bottom surface of the plates 220 each has a patch 230B of friction bearing material such as a rubber square to frictionally engage the surface of a corresponding side of the end of the dumbbell. In this way, the slippage of the adaptive weight belt 200 from each end of the dumbbell can be avoided.

Figure 3A:
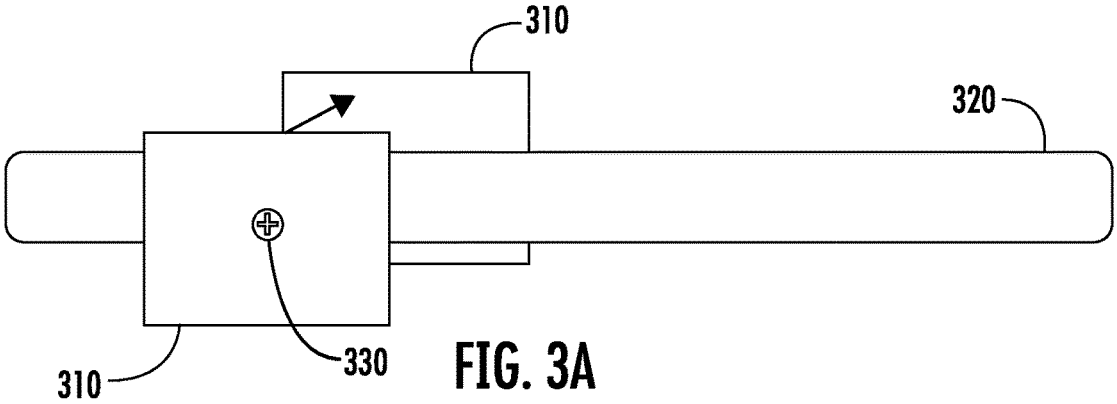
FIG. 3A is a schematic illustration of an adaptive weight belt including weight plates slidably secured to a strap and positionally fixed with a set screw.

Turning now to FIG. 3A, a schematic illustration is provided of an alternative aspect of one embodiment set forth in connection with FIGS. 2A and 2B. Specifically, as shown in FIG. 3A, an adaptive weight belt is formed from the friction compression of a fabric strap 320 with two opposing plates 310 whose combination has a specific weight value. To reinforce the inhibition of lateral movement of the opposing plates 310, a set screw 330 may be provided so that the clockwise rotation of the set screw intrudes into the fabric strap 320 to further prevent the lateral movement of the combination of opposing plates 310 along the fabric strap 320 once the position of the combination of opposing plates 310 has been established.

Figure 3B:
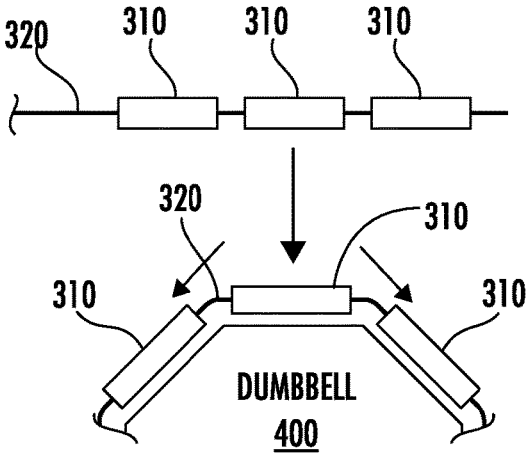
FIG. 3B is a two-sided view of an adaptive weight belt including a flexible fabric strap with an inflexible segment at a distal end of the strap.

In further illustration, referring now to FIG. 3B, it can be seen that the adaptive weight belt includes different plates 310 positioned on a strap 320. However to accommodate placement of each of the plates 310 upon a different face of a dumbbell 400, the plates 310 individually may slide along the strap to a position on the strap congruent with a corresponding surface of the dumbbell 400 as can be seen. In this way, the adaptive weight belt can accommodate different dumbbells of varying sizes simply by slidably adjusting a position of each of the plates 310 to correspond positionally with a face of the dumbbell 400.

Figure 3C:
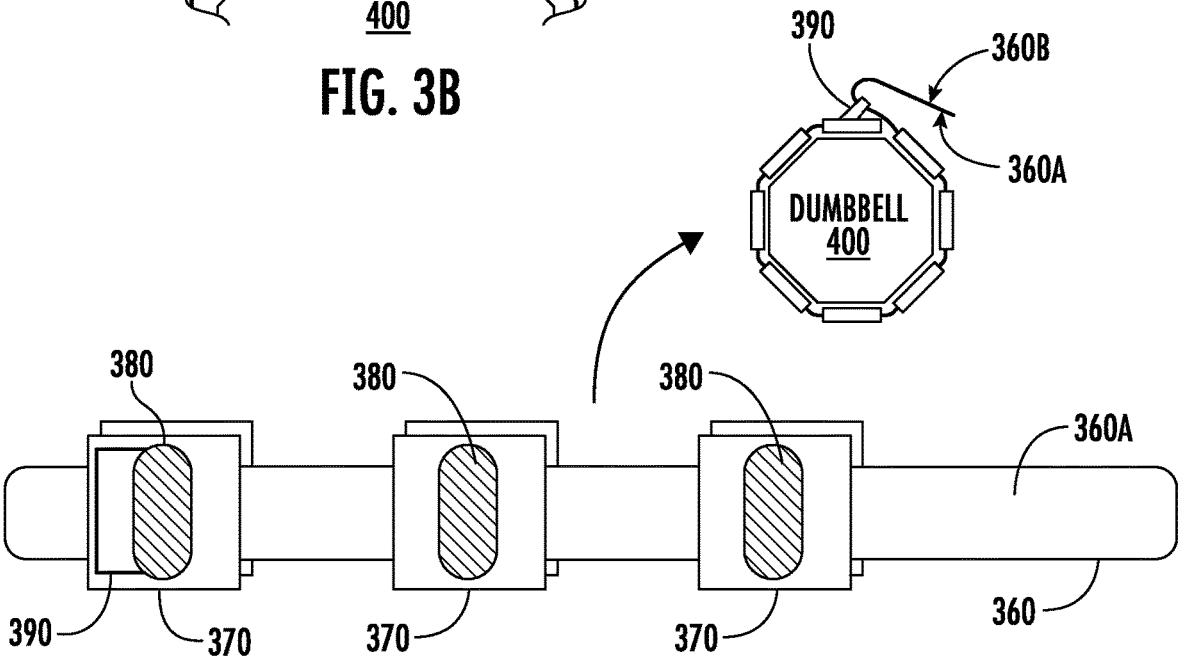
FIG. 3C is pictorial illustration of a multi-layering of an adaptive weight belt upon a barred weight with a d-ring affixed to a plate so as to reverse directionality of the strap of the adaptive weight belt; and, FIGS. 4A through 4D, pictorially illustrate an adaptive weight belt including a set of weight assemblies of different plate segments with each assembly being slidably secured to a strap.

Importantly, as illustrated in FIG. 3C, in even yet another aspect of the embodiment set forth in connection with FIGS. 2A and 2B, the adaptive weight belt may wrap an end of a dumbbell 400 multiple times so as to substantially increase the weight value of the dumbbell 400. In this regard, as shown in FIG. 3C, the adaptive weight belt may include multiple different plates 370 friction fitted to a fabric strap 360. However, because each of the plates 370 is slidably affixed to the strap 360, each of the plates 370 can be laterally adjusted on the strap 360 to correspond to a surface of a side of the dumbbell 400 with increasing distance between each of the plates 370 as the adaptive weight belt wraps the dumbbell 400. As shown the weight belt may wrap the dumbbell 400 once, or optionally, the weight belt may wrap the dumbbell 400 multiple times as a single belt (not shown). Even further, multiple different segments of the weight belt may wrap the dumbbell 400 multiple different times (not shown). As yet another alternative, each segment of the weight belt may wrap the dumbbell 400 more than once with multiple segments wrapping one another in order to achieve a desired increase in the weight of the dumbbell 400.

As shown in FIG. 3C, a top surface 360A of the strap 360 opposite a bottom surface 360B of the strap includes fastener material such as hook material. As well, a top surface of each of the plates 370 includes a patch of friction bearing material 380 such as loop material. For heavier weighted dumbbells, a D-ring 390 is secured to one or more of the plates 370 so that the strap 360 when passed through the D-ring 390 during wrapping of the dumbbell 400 reverses direction circumferentially and can become secured to a top surface of one or more of the plates 370 through the interaction of the fastener material of the top surface 360A of the fabric strap 360 and the patch of friction bearing material 380 of the one or more of the plates 370.

Figure 4A:
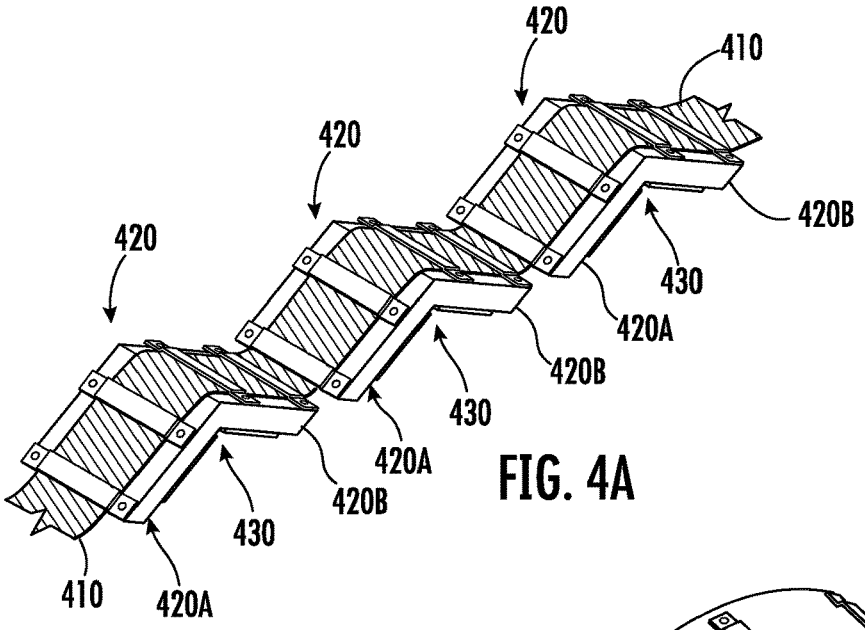

FIGS. 4A through 4D, pictorially illustrate an alternative embodiment of the invention in which the adaptive weight belt includes a set of weight assemblies of different plate segments with each assembly being slidably secured to a strap. As shown in FIG. 4A, each plate 420 can include a pair of plate segments 420A, 420B positioned adjacent to one another and at an obtuse angle 430 to one another. The strap 410 can slidably secure each of the plate assemblies 420 to one another so as to permit a form fitting of each of the plate assemblies 420 to the surface of a polygonally shaped circumferential surface of a bar weight such as a hexagonal or dodecagonal dumbbell.

Figure 4B:
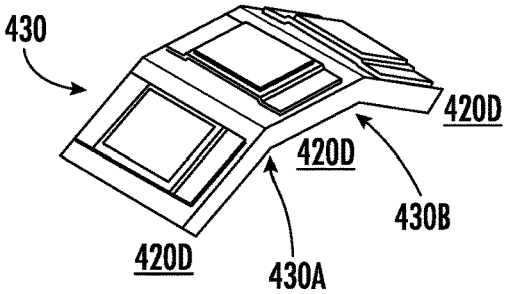
Figure 4D:
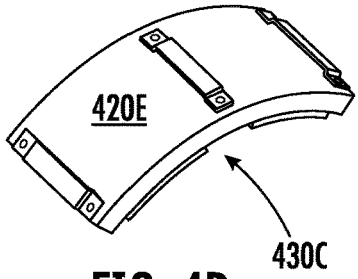
Figure 4C:
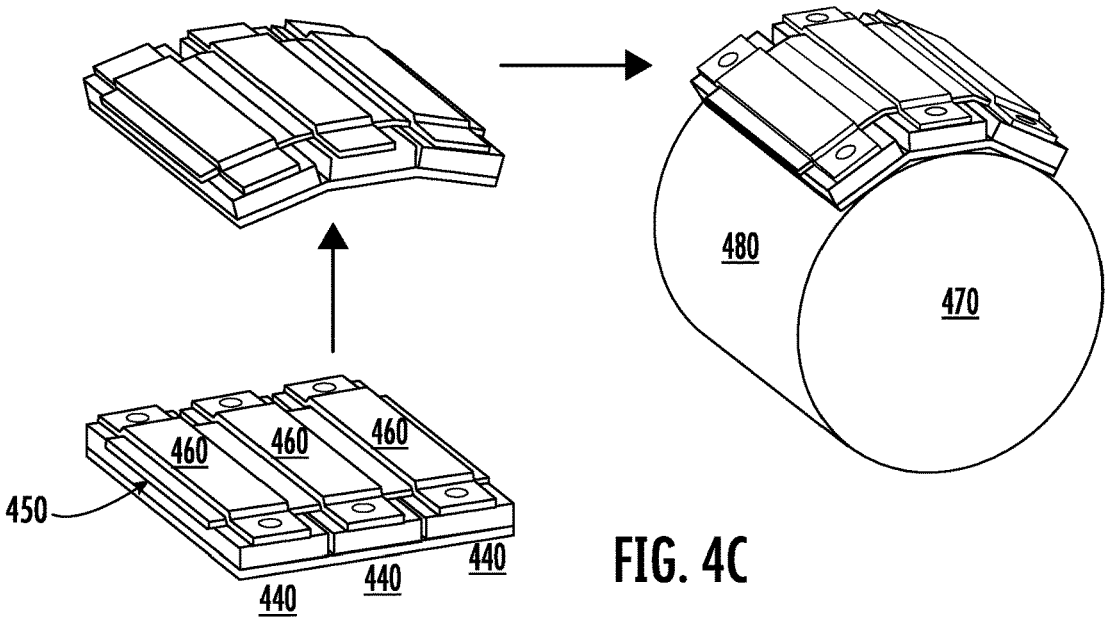

As it will be understood, however, the plate assemblies 420 need not be limited to only two plate segments 420A, 420B positioned to one another at a single obtuse angle 430. In alternative aspects of the embodiment, for instance as shown in FIG. 4B, each of the plate assemblies 420 can include multiple different segments 420D with two or pairs of the segments 420D being joined together at identical obtuse angles 430A, 430B. As well, in even yet another aspect of the embodiment, each of the plate segments 440 can be joined together at the base. In this way, when circumferentially secured to the surface 480 of a bar weight 470, the obtuse angle can be formed dynamically. And, as a third possibility shown in FIG. 4D, a single continuously curving plate 420E about a constant radius 430C can be provided.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "include", "includes", and/or "including," when used in this specification, specify the presence of stated features, elements, and/or components, but do not preclude the presence or addition of one or more other features, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows.

I claim:

1. An adaptive weight belt for incrementally increasing a weight characteristic of a bar weight, the weight belt comprising:

a fabric strap; and, multiple different metallic plates, each slidably enveloping a portion of the fabric strap, the slidable envelopment permitting each of the plates to slide along the fabric strap so as to permit a reconfigurable distance on the fabric strap between each of the plates, at least one of the plates comprising a patch of friction bearing material, an interior portion of the fabric strap having a fastener adapted for coupling to the friction bearing material, whereby the adaptive weight belt wraps a circumferential surface of one of two different weighted circumferential structures positioned oppositely along a bar of the bar weight, thereby incrementally increasing the weight characteristic of the bar weight.

2. The adaptive weight belt of claim 1, wherein the fastener is a loop surface and the friction bearing material is a hook surface engaging the loop surface.

3. The adaptive weight belt of claim 1, wherein the fastener is a hook surface and the friction bearing material is a loop surface engaging the hook surface.

4. The adaptive weight belt of claim 1, wherein each said plate slidably envelops the strap in a channel defined by a top surface of said plate and a cross member fixed to the top surface.

5. The adaptive weight belt of claim 1, wherein the patch of friction bearing material is disposed upon a cross member affixed to one surface of said at least one of the plates.

6. The adaptive weight belt of claim 1, wherein each said plate comprises a pair of sub-plates fixed to one another about the strap and frictionally engaging each surface of the strap with a corresponding interior surface of each of the sub-plates.

7. The adaptive weight belt of claim 1, further comprising a thumbscrew positioned through a top surface of one of the plates to a bottom surface of the plate and embedded into the strap to prevent lateral movement of the plate along the strap.

8. An adaptive weight belt for incrementally increasing a weight characteristic of a bar weight, the weight belt comprising:

a fabric strap; and, multiple different metallic plates, each slidably enveloping a portion of the fabric strap, the slidable envelopment permitting each of the plates to slide along the fabric strap so as to permit a reconfigurable distance on the fabric strap between each of the plates, at least one of the plates comprising a patch of friction bearing material, at least one other of the plates additionally comprising a ring, a surface of the fabric strap at a distal end of the strap having a fastener adapted for coupling to the friction bearing material after having been passed through the ring, whereby the adaptive weight belt wraps a circumferential surface of one of two different weighted circumferential structures positioned oppositely along a bar of the bar weight, thereby incrementally increasing the weight characteristic of the bar weight.

9. The weight belt of claim 8, wherein the surface is a top surface such that the fastener couples to the friction bearing material after having reversed direction around the circumferential surface of the bar weight when passed through the ring.

10. The weight belt of claim 8, wherein the surface is a bottom surface such that the fastener couples to the friction bearing material after having continued in a same direction around the circumferential surface of the bar weight when passed through the ring.

11. An adaptive weight belt for incrementally increasing a weight characteristic of a bar weight, the weight belt comprising:

a fabric strap; and, multiple different metallic plate assemblies, each slidably enveloping a portion of the fabric strap, the slidable envelopment permitting each of the plate assemblies to slide along the fabric strap so as to permit a reconfigurable distance on the fabric strap between each of the plate assemblies, each of the plate assemblies comprising two or more plate segments positioned immediately adjacent to one another at respective edges and at an obtuse angle to one another when secured to an outer surface of a weighted circumferential structure of the bar weight, at least one of the plate assemblies comprising a patch of friction bearing material, an interior portion of the fabric strap having a fastener adapted for coupling to the friction bearing material.

12. The adaptive weight belt of claim 11, wherein the plate segments are removably secured to another but permitted to position against one another at the obtuse angle by a flexing of the fabric strap.

13. The adaptive weight belt of claim 11, wherein the plate segments are formed from a unitary body of material.

14. The adaptive weight belt of claim 11, wherein each plate assembly comprises two plate segments.

15. The adaptive weight belt of claim 11, wherein each plate assembly comprises three plate segments positioned in sequence to one another as two adjacent pairs of the segment, and a first angle formed by a first one of the adjacent pairs is equivalent to a second angle formed by a second one of the adjacent pairs.

16. The adaptive weight belt of claim 11, wherein each plate assembly comprises a single continuously curving plate about a constant radius.

* * * * *